US007345634B2

(12) United States Patent
Ozkar et al.

(10) Patent No.: US 7,345,634 B2
(45) Date of Patent: Mar. 18, 2008

(54) PLANAR INVERTED "F" ANTENNA AND METHOD OF TUNING SAME

(75) Inventors: Mete Ozkar, San Diego, CA (US); Gregory Poilasne, San Diego, CA (US)

(73) Assignee: Kyocera Corporation, Kyoto (JP)

( * ) Notice: Subject to any disclaimer, the term of this patent is extended or adjusted under 35 U.S.C. 154(b) by 167 days.

(21) Appl. No.: 10/922,353

(22) Filed: Aug. 20, 2004

(65) Prior Publication Data

US 2006/0038721 A1 Feb. 23, 2006

(51) Int. Cl.
*H01Q 1/24* (2006.01)

(52) U.S. Cl. ..... 343/702; 343/700 MS

(58) Field of Classification Search ..... 343/700 MS, 343/702, 847, 846, 848
See application file for complete search history.

(56) References Cited

U.S. PATENT DOCUMENTS

| | | | | |
|---|---|---|---|---|
| 5,148,181 | A * | 9/1992 | Yokoyama et al. | 343/702 |
| 5,764,190 | A * | 6/1998 | Murch et al. | 343/702 |
| 5,966,097 | A * | 10/1999 | Fukasawa et al. | 343/700 MS |
| 6,297,776 | B1 * | 10/2001 | Pankinaho | 343/700 MS |
| 6,456,249 | B1 * | 9/2002 | Johnson et al. | 343/702 |
| 6,614,400 | B2 * | 9/2003 | Egorov | 343/702 |
| 6,903,687 | B1 * | 6/2005 | Fink et al. | 343/700 MS |
| 7,012,570 | B2 * | 3/2006 | Chen et al. | 343/700 MS |
| 2001/0007445 | A1 * | 7/2001 | Pankinaho | 343/844 |
| 2002/0070902 | A1 * | 6/2002 | Johnson et al. | 343/702 |
| 2002/0140612 | A1 * | 10/2002 | Kadambi et al. | 343/702 |
| 2002/0186169 | A1 * | 12/2002 | Iwai et al. | 343/702 |
| 2004/0070537 | A1 * | 4/2004 | Kadambi et al. | 343/700 MS |
| 2004/0140933 | A1 * | 7/2004 | Shikata et al. | 343/700 MS |
| 2004/0145521 | A1 * | 7/2004 | Hebron et al. | 343/700 MS |
| 2004/0198293 | A1 * | 10/2004 | Sadler et al. | 455/280 |
| 2005/0116875 | A1 * | 6/2005 | Yuanzhu et al. | 343/846 |
| 2005/0184914 | A1 * | 8/2005 | Ollikainen et al. | 343/702 |
| 2006/0033667 | A1 * | 2/2006 | Johnson | 343/702 |

OTHER PUBLICATIONS

Li et al., "Development And Analysis Of A Folded Shorted-Patch Antenna With Reduced Size", IEEE Transactions On Antennas And Propagation, vol. 52/2, pp. 555-562, Feb. 2004.*
Li et al., "Development and Analysis of a Folded Shorted-Patch Antenna With Reduced Size", IEEE Transactions on Antennas and Propagation, vol. 52/2, pp. 555-562, Feb. 2004.

(Continued)

*Primary Examiner*—Hoanganh Le

(57) ABSTRACT

A multiband planar inverted F antenna (PIFA) can provide improved performance and operating efficiency, and utilizes a capacitive element configured to provide high efficiency operation, and a tuning area that allows the antenna to be tuned independently of the capacitive element. As a result of this feature, the antenna can be tuned to the desired operating frequencies, while allowing the capacitive element to remain configured for optimal operating efficiency. The antenna can be configured in a loop for effective utilization of a given volume and can therefore be relatively small in size and high efficiency. A capacitive loading section can be included to allow improved antenna efficiency and radiation. Additionally, tuning section can be provided to allow the antenna to be tuned without adjusting the capacitive loading section. To obtain operation at an additional frequency band, a parasitic element or a slot configuration can be included.

13 Claims, 4 Drawing Sheets

OTHER PUBLICATIONS

Rowell, C.R. et al., A Compact PIFA Suitable for Dual-Frequency 900/1800-MHz Operation, IEEE Transactions on Antennas and Propagation, vol. 46/4, pp. 596-598, Apr. 1998.

Taga, T., "Analysis of planar inverted-F antennas and antenna design for portable radio equipment", in Analysis, Design & Measurement of Small & Low-Profile Antennas, K. Hirasawa & M. Haneishi, Eds. Norwood, MA, Artech House, pp. 161-180, 1992.

* cited by examiner

PLANAR INVERTED "F" ANTENNA AND METHOD OF TUNING SAME

BACKGROUND

1. Field of the Invention

The present invention relates generally to wireless communication devices, and more specifically to a relatively compact antenna (PIFA) suitable for use in such devices.

2. Description of Related Art

Wireless communication equipment, such as cellular and other wireless telephones, wireless network (WiLAN) components, GPS receivers, mobile radios, pagers, and other wireless devices are enjoying increasing popularity in the contemporary marketplace. One reason for their increasing popularity is the large number of applications that such devices are now capable of supporting. Additional reasons include enhanced user interfaces, longer battery life, increasing affordability, and improved operability, among others.

One critical feature of wireless devices not often contemplated by their users is the antenna, which provides a region of transition between a signal in a guided wave within the device and a free space wave. After all, it is the antenna, which can be used to both transmit and receive information signals, that allows the wireless device the ability to communicate across a wide range. Antenna technology continues to advance rapidly and such advances are instrumental in enabling higher performance and smaller packaging in wireless devices. For example, enhancements in antenna technology can yield increased performance in terms of higher signal strength, improved reception of weaker signals, longer battery life, increased (or narrowed, if desired) bandwidth and smaller packaging.

Perhaps the most common antenna is a simple whip antenna, having a length that is typically $\lambda/8$, $\lambda/4$ or $\lambda/2$ (where $\lambda$ is the wavelength). The popularity of whip antennas is attributed to their low cost, ease of manufacture and simplicity of implementation. They operate over a wide bandwidth and provide a radiation pattern that is well suited to mobile applications. In place of whip antennas, helical antennas are sometimes used in wireless devices. A helical antenna includes one or more conductive radiators wound in the shape of a helix. An feature of the helical design is its small size, and, for certain applications such as GPS receivers, its circular polarization. Although they enjoy widespread use, whip and helical antennas protrude from the package and are prone to breakage if the phone is mishandled. Also, their length tends to interfere with the form factor of the device, especially for handheld or portable applications.

To avoid some of the drawbacks associated with whip and helical antennas, conventional systems often utilize what are commonly known as microstrip, or patch, antennas to obtain modest performance from a relatively small package. Such antennas utilize a conductive material formed in a stripline, rectangular, circular or other shape, and disposed on a dielectric substrate of certain dielectric value and thickness. The shape of the conductor is chosen to achieve the desired resonant frequency and radiation pattern. Selecting a lower substrate permittivity and a larger patch size yields a higher antenna efficiency. Impedance matching is optimized by selecting an appropriate location on the patch for the feed point. Excitation via the feed results in a charge distribution on the underside of the patch and the ground plane. The patch antennas allow a great flexibility in antenna and wireless-device design, as they are cost-effective, easily manufactured, and can be conformed to the shape of the wireless device.

A derivation of the patch antenna is what is commonly known as a planar inverted F antenna, or PIFA. The PIFA can resonate at a much smaller patch size for fixed operating frequency as compared to the conventional patch antenna. It is generally a $\lambda/4$ resonant structure and is implemented by short-circuiting the radiating element to the ground plane using a conductive wall, plate or post. Thus, the conventional PIFA structure consists of a conductive radiator element disposed parallel to a ground plane and insulated from the ground plane by a dielectric material, usually air. This radiator element is connected to two pins, typically disposed toward one end of the element, giving the appearance of an inverted letter "F" from the side view. One pin electrically connects the radiator to the ground plane, the other pin provides the antenna feed. Impedance matching is obtained by selecting correct positioning of the feed and ground contacts. Thus, the conventional PIFA structure is similar to a shorted rectangular microstrip patch antenna.

These and other conventional antenna solutions offer good performance at attractive prices in relatively small packages. Despite these qualities, however, antenna designers continue to strive to improve operating efficiency, enhance multi-band operation, minimize losses resulting from capacitive tuning, and decrease the antenna's sensitivity to its surroundings.

SUMMARY

In summary, the present invention provides a novel and improved antenna configuration utilizing a capacitive element configured to provide high efficiency operation, and a tuning area that allows the antenna to be tuned independently of the capacitive element. As a result of this feature, the antenna can be tuned to the desired operating frequencies, while allowing the capacitive element to remain configured for optimal operating efficiency.

In one implementation, the antenna is a planar inverted F antenna (PIFA) that is configured in a loop, separated from a ground plane by a dielectric so as to provide radiation of the wireless signals, although other shapes are contemplated and acceptable. The loop configuration can provide an antenna pattern that makes effective utilization of a given volume and is therefore relatively small in size and high efficiency.

According to one embodiment of the antenna, the PIFA includes a capacitive loading section, providing for optimal antenna efficiency and thus optimal signal strength. Capacitive loading can be used to obtain a decrease in antenna size without suffering from any appreciable accompanying efficiency trade-off, and is optimized to allow the antenna to radiate efficiently.

Additionally, in one embodiment, an antenna tuning section is provided to allow the antenna to be tuned without adjusting the capacitive loading section. As such, the antenna can be optimized for maximum efficiency using the capacitive loading, and then tuned appropriately without any appreciable impact to the efficiency. Therefore, a feature of including one or more independent tuning sections, is that they can be used to tune the antenna independently of the capacitive loading element. As a result, the tuning can be done in a manner so as to have little or even no impact on the efficiency established by the capacitive loading element.

A parasitic element can be included to allow operation of the antenna at a second frequency band. Use of such a parasitic element allows the antenna to be operated at a second frequency band with little or no compromise to its operation at the first frequency band. Additional features can be added to the antenna, such as slits, for example, to allow the antenna to operate at additional frequency bands.

These and other features will become apparent by review of the figures and detail descriptions that follow.

BRIEF DESCRIPTION OF THE DRAWINGS

The present invention is described herein with reference to the following drawings. The drawings are provided for purposes of illustration only and not limitation. It should be noted that for clarity and ease of illustration these drawings are not made to scale.

DETAILED DESCRIPTION

The described example implemention is directed toward a highly efficient and tunable antenna. In this example, the antenna is in the form of a multi-band planar inverted F antenna (PIFA) having a capacitive element configured to provide high efficiency operation, and a tuning area that allows the antenna to be tuned while maintaining a desirable level of efficiency. More specifically, the tuning area can be configured to tune the antenna to the desired operating frequencies, while allowing the capacitive element to remain configured for optimal operating efficiency.

The antenna is described from time to time herein in terms of an example application, which includes dual-band CDMA and GSM radiotelephones operating at the 800 MHz and 1900 MHz frequency bands. After reading this description, it will become apparent to one of ordinary skill in the art how to implement the antenna for other applications in other wireless devices and operating at other frequency bands, including without limitation cellular and other radio telephones conforming to alternative standards, portable radios, pagers, and WLAN devices, to name a few.

Figure 1:
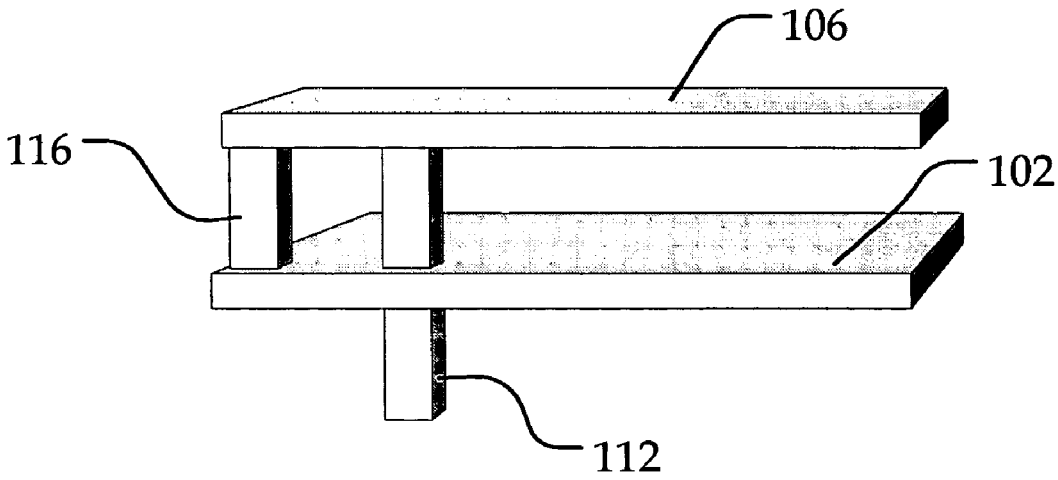
FIG. 1 is a diagram illustrating a simplified PIFA configuration.

FIG. 1 is a diagram illustrating a perspective view of a simplified PIFA configuration. Referring now to FIG. 1, this simplified PIFA configuration includes a conductive plate, which forms a radiating element 106 of the antenna. Radiating element 106 is disposed approximately parallel to a second conductive plate, which forms a ground plane 102. Radiating element 106 is electrically connected to ground plane 106 via a ground pin 116, which is typically disposed at one end of element 106. A feed 112 is used to connect a signal source or sink to radiating element 106.

Figure 2:
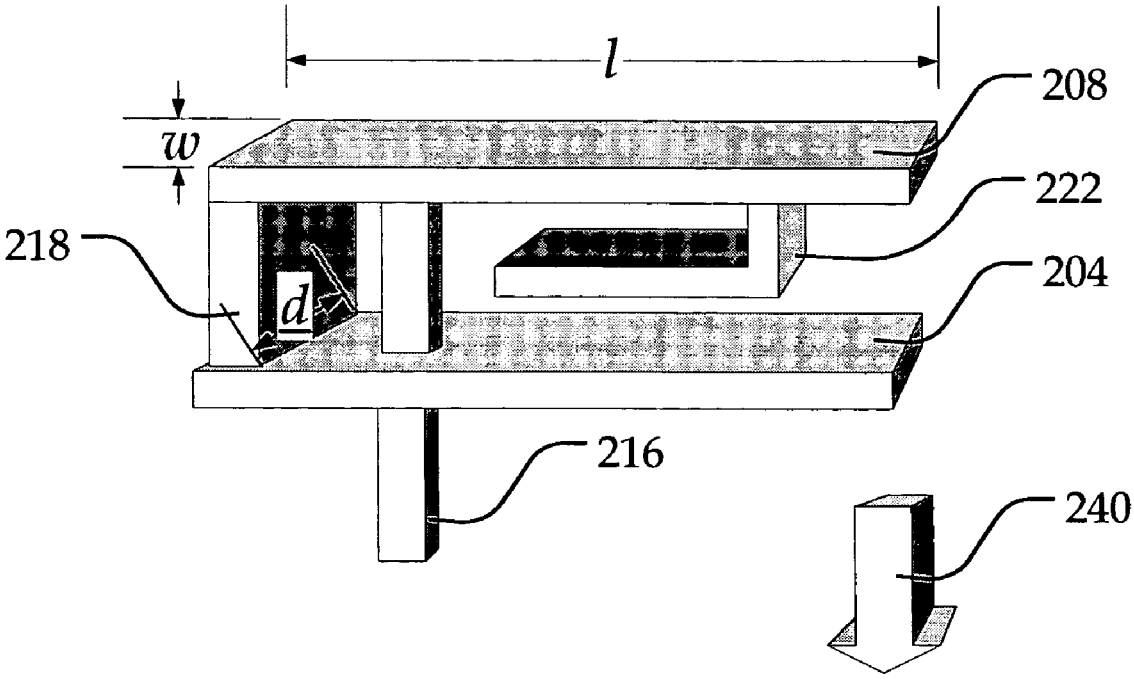
FIG. 2 is a diagram illustrating a perspective view of an antenna configuration in accordance with one embodiment of the invention.

FIG. 2 is a diagram illustrating a PIFA having a capacitive coupling feature in accordance with one embodiment of the antenna. In the illustrated embodiment, the PIFA includes a conductive structure forming a radiating element 208. In one example embodiment, radiating element 208 is disposed approximately parallel to a ground plane 204 also formed from a conductive plate. Although in this embodiment elements 204, 208 are roughly parallel, other orientations are possible, however, the parallel orientation provides optimal performance. Ground plane 204 is illustrated as being rectangular in shape and roughly the same size as radiating element 208. However, ground plane 204 can be configured in alternative shapes or patterns and does not need to be the same size as radiating element 204.

In one embodiment, ground plane 204 is formed using a ground plane embedded in the printed circuit board accommodating the wireless device's circuitry. This embodiment provides the quality that additional materials need to be utilized to manufacture ground plane 204. This embodiment also provides the quality that the antenna can be mounted relatively close to the printed circuit board, thus saving volume in the wireless device. In this embodiment, because the printed circuit board may be larger than the antenna's radiator structure, ground plane 204 may cover a larger area than radiating element 208, depending on the size of the circuit board to which the antenna is mounted.

Figure 4:
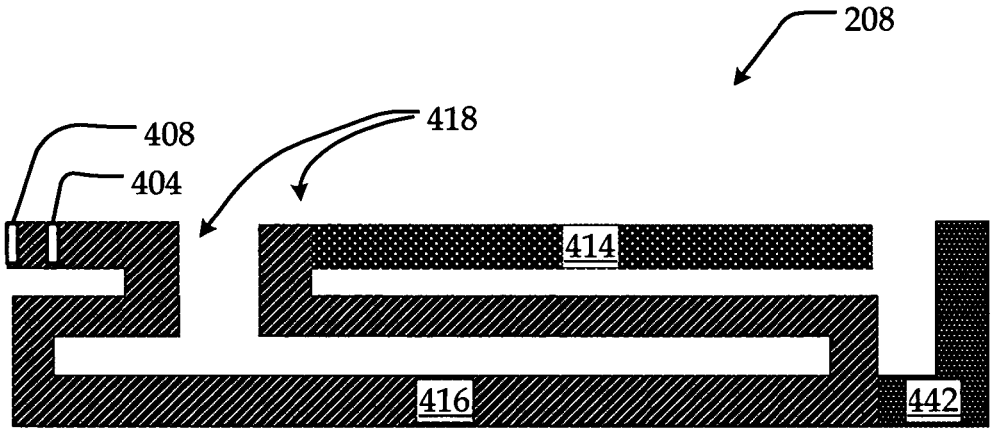
FIG. 4 is a diagram illustrating a top-down view of an antenna configuration in accordance with one embodiment of the invention.
Figure 5:
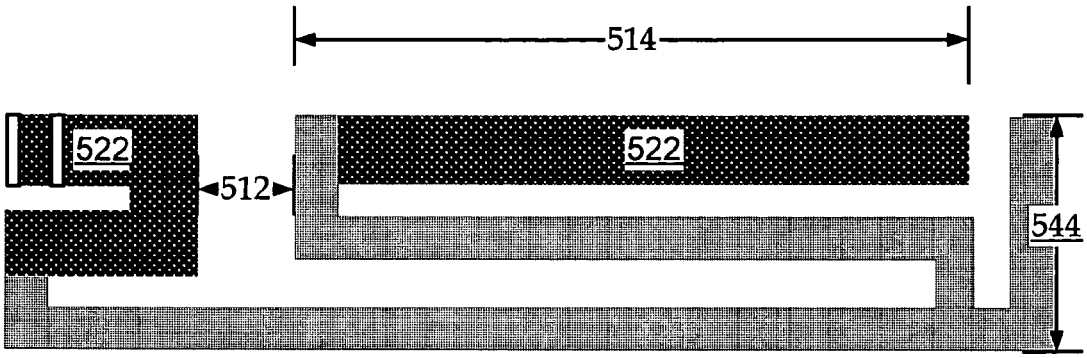
FIG. 5 is a diagram illustrating a top-down view of an antenna configuration in accordance with one embodiment of the invention.
Figure 6:
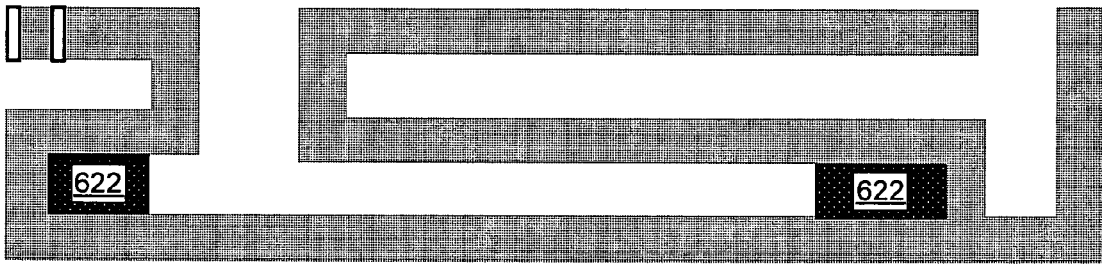
FIG. 6 is a diagram illustrating a top-down view of an antenna having one or more tuning segments in accordance with one embodiment of the invention.

Although illustrated as rectangular in shape, radiating element 208 can also be configured in other shapes or patterns, and in varying sizes to optimize bandwidth, operating frequency, radiation patterns and the like. In fact, numerous alternative configurations of radiating element 208 are possible, some of which are discussed in more detail below. For ease of discussion, arrow 240 is included in FIG. 2 to provide a frame of reference for a embodiments of the PIFA as illustrated in FIGS. 4, 5, and 6. In FIGS. 4, 5 and 6, the phrase "top-down view" means a view of the antenna looking at the structure in the direction indicated by the arrow. Likewise, the words "side view" indicate a view of the structure perpendicular to arrow 240. It should be noted that the words "top-down" and "side" do not indicate a required orientation in space of the antenna in a given application. Instead they are used only for clarity of explanation.

Radiating element 208 is electrically connected to ground plane 204 via a ground wall, pin or post 218 (generally referred to as ground post 218), which, in the illustrated embodiment, is a single ground post 218 disposed at one end of radiating element 208. Additional ground posts can be included depending on the application. Also, additional connections may be made, including non-conductive connections used to support the radiator element. By way of example without limitation, the end of radiating element 208 opposite ground post 218 may be connected to the housing of the wireless device for support, or non-conductive spacers may be included to help support radiating element 208 in its application.

A feed 216 connects a signal source or sink, typically from a radio or other RF transmitter, receiver or transceiver, to radiating element 208. Although not illustrated, it is desirable that feed 216 be somewhat electrically insulated from ground plane 204 to prevent grounding of signals carried thereon. Depending on the application, feed 216 is located at a position proximal to ground post 218. The exact proximity of feed 216 to ground post 218 is determined so as to provide proper matching for the antenna to the wireless device's feed circuitry. In one embodiment as described below with reference to FIG. 4, feed 216 is separated from ground post 218 by approximately five millimeters (5 mm), however greater or lesser spacing distances can be selected.

The PIFA illustrated in FIG. 2 also includes an additional conductive element 222 used to provide capacitive loading of the antenna via capacitive coupling. Capacitive coupling allows the transfer of energy from one element to another by means of the mutual capacitance between the elements. Varying the value of the capacitance changes the reactance of the antenna $X_c$, and, as a result the resonant frequency of the antenna $f_r$. The capacitive loading confines the fields inside the antenna volume, increasing operating efficiency. Although conductive element 222 is illustrated as separate from but electrically connected to radiating element 208, these two elements 222, 208 can be made using a single piece of conductive material, or other configurations of multiple sections. Likewise, as would be appreciated by one of ordinary skill in the art after reading this description, other electrically connected elements that appear in FIG. 2 and in the other diagrams as separate elements of conductive material can be fashioned from one continuous section or alternatively multiple sections of conductive material.

The parameters of PIFA can be adjusted by varying the dimensions with respect to one another. For example, an increase in the spacing between radiating element 208 and ground plane 204 widens the bandwidth of the antenna. Reducing width d of ground post 218 (d<w) reduces the overall dimension and also the bandwidth, while adjusting L allows frequency tuning. As understood by one of ordinary skill in the art, such modifications change the position of the point at which feed 216 is optimally connected for a given impedance. Adding an etched slot on radiating element 208 allows the PIFA to operate in multi-band mode. Other techniques that can be used to provide multi-band operation are discussed in detail below.

The impedance bandwidth of the PIFA is affected by the length and width of the ground plane as well. This is especially true for mobile handset applications that operate at the 900 MHz and 1800 MHz frequency bands utilized in the example application. Therefore, the dimensions of the ground plane should be optimized to obtain acceptable return loss and appropriate bandwidth.

Depending on the desired configuration, more than one ground post 218 can be utilized in the antenna design. The effect of multiple ground posts 218 in various configurations can be modeled by treating them as lengths of a transmission line, where their length is the height from ground plane 204 to radiating element 208. Therefore, the ground posts 218 add inductance and capacitance to antenna structure. For multiple ground posts 218, the series inductance is the total of the self-inductances of all ground posts 218 and the capacitance is due to the close proximity of the ground posts 218. The values of inductance and capacitance depend on the number of ground posts 218, their radius, the separation between them, and the permittivity and permeability of the substrate.

Although numerous configurations are possible, in the embodiment illustrated in FIG. 2, conductive element 222 extends from radiating element 208 in a direction toward ground plane 204. In this embodiment, however, conductive element 222 does not extend all the way to ground plane 204, but instead at approximately the half-way point extends in a direction roughly parallel to ground plane 204 and radiating element 208. In one embodiment, the dielectric material between ground plane 204, radiating element 208 and conductive element 222 is air or foam, although other dielectrics may be used.

Figure 3:
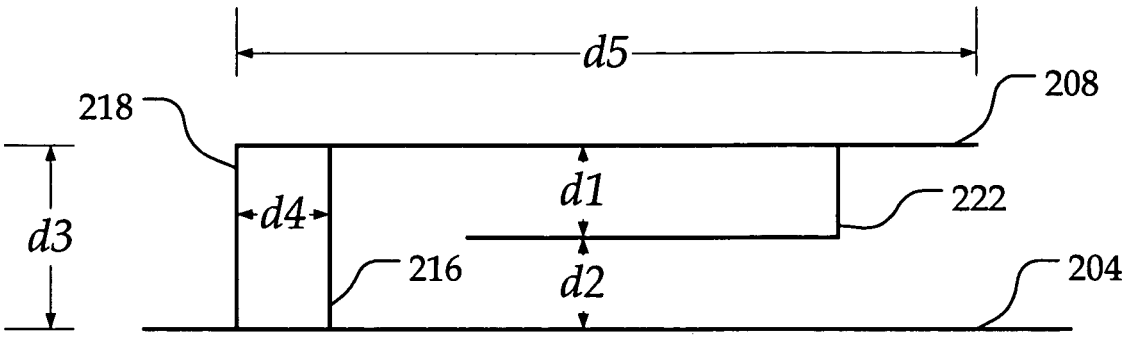
FIG. 3 is a diagram illustrating a side view of an antenna configuration in accordance with one embodiment of the invention.

As the discussion above indicates, dimensions of the various components that make up the PIFA can be crucial to optimal operation of the antenna. While this discussion allows the antenna designer to optimize the PIFA for his or her own application, FIG. 3 is provided as an aid to illustrate the dimensions chosen for one implementation of the antenna. These dimensions have been selected for the example application of the dual-band CDMA and GSM telephones operating at the 800 MHz and 1900 MHz frequency bands.

Referring now to FIG. 3, a side view of the PIFA is shown in accordance with one embodiment of the antenna. This side view illustrates the spatial relationship between ground plane 204, radiating element 208, ground post 218, feed 216 and conductive element 222. In this example embodiment, the separation distance d1 between radiating element 208 and conductive element 222 is four millimeters (4 mm). Likewise, the separation distance d2 between conductive element 222 and ground plane 204 is four millimeters (4 mm), making the total separation distance d3 between radiating element 208 and ground plane 204 approximately eight millimeters (8 mm).

In this implementation, the separation distance d4 between ground post 218 and feed 216 is approximately five millimeters (5 mm), and the overall length d5 of radiating element 208 is approximately 35 millimeters (35 mm). Utilizing these dimensions, the overall volume of the fabricated antenna becomes approximately 1.68 cubic centimeters, including the ground plane 204.

FIG. 4 is a diagram illustrating a top-down view of one possible configuration of a radiating element 208. In this embodiment, radiating element 208 is formed in a relatively tight loop, to maximize volume utilization. In this embodiment, radiating element 208 can be described as having two inverted L sections positioned adjacent to, and electrically connected to a partially closed loop section. This loop arrangement can be utilized to provide confinement of the fields. As a result, the antenna is not as sensitive to its surroundings, providing more consistent and reliable operation. Alternatively, another way to increase the immunity to interference from surroundings would be to use a higher dielectric material, however the increased permittivity of the higher dielectric material would result in greater losses, which is an undesirable effect.

Radiating element 208 includes a first section 416 and a second section 414. Also illustrated in FIG. 4 are a ground post 408 and feed pin 404. Optionally included is a parasitic element 442, which is added to provide operation at a second frequency band, yielding low-band and high-band operation at chosen frequencies. Additionally, in this and other embodiments, a slot could be utilized in radiating element 208 to provide operation at another frequency band. In one embodiment, such a slot could be either L-shaped or U-shaped. A U-shaped parasitic element increases the field storage due to coupling. The L-shaped parasitic tends to favor high band operation whereas the U-shaped parasitic tends to favor low band operation.

As would be apparent to one of ordinary skill in the art after reading this description, alternative modifications can be made to the antenna to allow operation at multiple frequency bands.

As illustrated, parasitic element 442 is a parasitic element that provides operation at the higher frequency band. The addition of this parasitic element lets the designer match the antenna at a higher operating frequency, thereby providing dual-band operation without compromising the performance of the antenna at the low-frequency band. Parasitic element 442 could be folded under to provide capacitive coupling, but, depending on the operating frequency, such folding may not be necessary. For example, in the example application where the higher frequency is 1900 MHz, folding is not necessary as capacitive coupling is less critical at this wavelength.

First section 416 can be adjusted to tune the antenna for low-band operation. Likewise, parasitic element 442 can be adjusted to tune the antenna for high-band operation. Second section 414 is the capacitive loading location, which can allow the designer to confine the fields inside the antenna volume. In this configuration, second section 414 can be selected such that capacitive loading is optimized for antenna operating efficiency, while first section 416 is used to tune the antenna.

The longer low-band element 418 (comprising sections 414 and 416) resonates at the lower frequency. The physical length of this element 418 roughly corresponds to a quarter wavelength, or $\lambda/4$, as compensated for by local dielectric effects and the parasitic shunt capacitance of parasitic element 442. For low-band operation at 800 MHz, $\lambda/4$ is approximately 89 mm.

The high-band parasitic element 442 resonates at the higher frequency, which is desirable to be maintained at less than three times the low-band frequency, and in the case of the example application, is approximately 1900 MHz. Without parasitic element 442, the antenna would radiate at a second resonance of $\lambda/2$, which is approximately 1600 MHz in the example application. With some matching, it is possible to tune the antenna so that it radiates at 1800 or 1900 MHz. With the configuration illustrated in FIG. 4, parasitic element 442 provides the matching function used to tune the high band.

The load on the high-band resonant impedance is element 418 shunt parasitic load across the inductive ground tab. At this frequency, the low-band element's impedance must be higher than the impedance of the high-band element. It should be noted that in typical operation, the unused element represents a parasitic load on the used element. Therefore, the tuning of one element may have an effect on the other.

As described above, placement of feed point 404 is crucial for obtaining optimum impedance matching. In the illustrated embodiment, placing the feed point 404 in close proximity to ground post 408 alters the generally low impedance of the antenna, e.g., which can be 10 Ω or less, to a more useful value without the need for adding external components to the antenna configuration. In one embodiment of the application, feed point 404 is positioned five millimeters (5 mm) from ground post 408 along section 416, with ground post 408 being closest to the end of the radiating element section 416.

It is useful to consider the size and shape of the wireless device with which the antenna is to be used when selecting a layout of the antenna for a specific application. Simulation software and other tools can be utilized to optimize the layout of radiating elements, ground posts and the feed. Although not required with the example application, external matching components could be added to the antenna to provide broadband operation of the low-band element.

FIG. 5 is a diagram illustrating a top-down view of the radiator configuration illustrated in FIG. 4, but with certain other dimensions illustrated. In this embodiment and in accordance with the example application, cross-hatched areas 522 (e.g., capacitive loading section 414 and a portion of first section 416) are slightly wider than the remaining portions of section 416 and parasitic element 442. Specifically, cross-hatched areas 522 in the illustrated embodiment are approximately two millimeters (2 mm) wide, while the remaining portions of section 416 and parasitic element 442 are approximately one millimeter (1 mm) wide. Spacing 512 is approximately one millimeter (1 mm), while length 514 and width 544 of the structure are approximately 35 millimeters (35 mm) and six millimeters (6 mm), respectively. Again, one of ordinary skill in the art after reading this discussion will understand how to implement the antenna using alternative dimensions and configurations from those illustrated in this embodiment.

FIG. 6 is a diagram illustrating a top-down view of the radiator configuration illustrated in FIG. 4, but with the addition of one or more tuning elements 622 provided in accordance with one embodiment. Referring now to FIG. 6, tuning element 622 is a conductive element provided to allow the antenna to be tuned without changing the capacitive coupling of the antenna. Tuning can be accomplished by adjusting the length of the conductive elements as well as by adding a circuit element such as a diode or resistor, or other element. According to this embodiment, the one or more tuning elements are altered in size, shape or position to change the frequency of operation of the antenna. For example, providing a longer tuning element 622 results in tuning to a higher frequency and a smaller tuning area results in a lower frequency operation. As a result of providing one or more tuning elements 622 in the configuration, the antenna designer can set the capacitive value for optimum efficiency and then tune the antenna using tuning element 622, without substantially affecting the capacitive value. In fact, in certain configurations, tuning can be accomplished by adjusting the one or more tuning elements 622 with little or no change in the antenna efficiency established by the capacitive loading.

Figure 7:
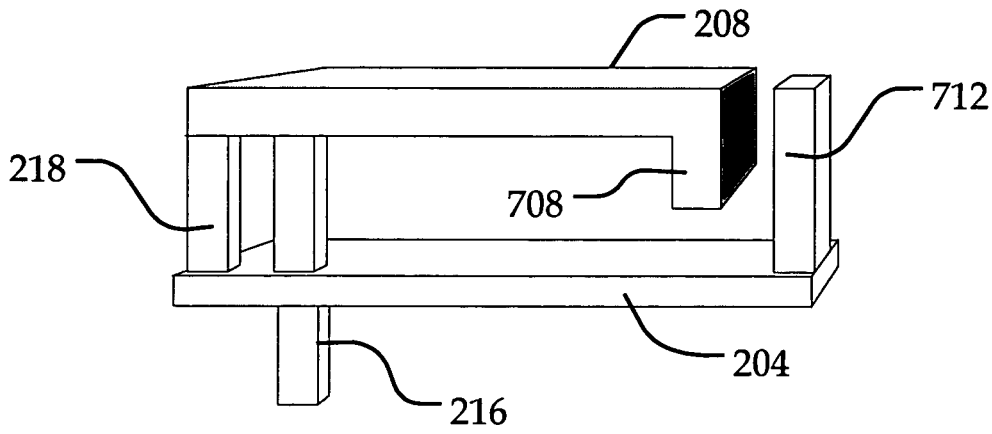
FIG. 7 is a diagram illustrating a perspective view of an antenna having an alternative configuration to provide capacitive loading in accordance with one embodiment of the invention.

FIG. 7 is a diagram illustrating an alternative configuration for providing capacitive coupling according to one example embodiment of the antenna. Referring now to FIG. 7, in accordance with this embodiment, capacitive loading element 708 extends from radiating element 208 toward ground plane 204. In one embodiment, capacitive loading element 708 spans approximately half the distance between radiating element 208 and ground plane 204, although other lengths for capacitive loading element 708 are possible. In order to provide capacitive coupling to ground, a ground extension 712 extends from ground plane 204 in a direction toward the plane of radiating element 208 such that it is roughly parallel to capacitive loading element 708. In this configuration, capacitive coupling from capacitive loading element 708 to ground via ground extension 712 provides the capacitive loading function similar to that obtained by conductive element 222 illustrated in FIG. 2.

Figure 8:
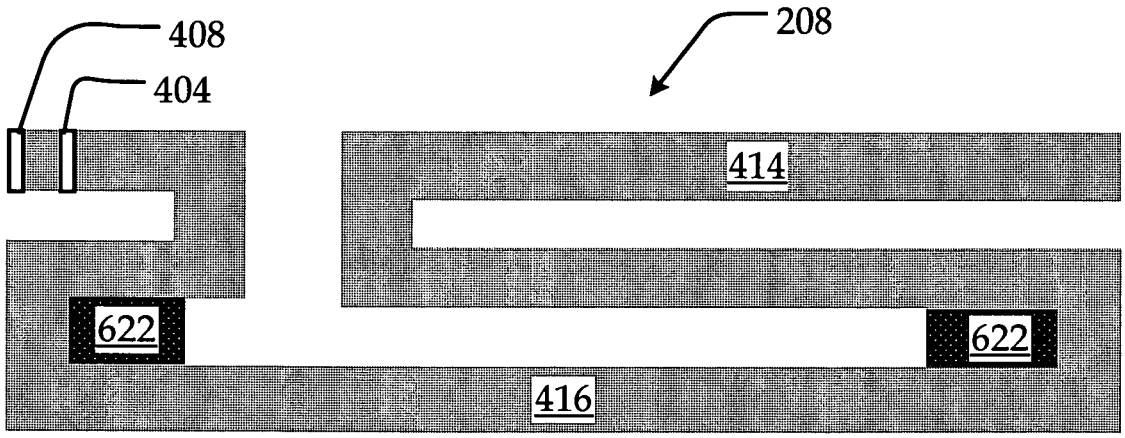
FIG. 8 is a diagram illustrating a top-down view of another possible configuration of a radiating element 208 in accordance with one embodiment of the invention.

FIG. 8 is a diagram illustrating a top-down view of another possible configuration of a radiating element 208. Referring now to FIG. 8, this embodiment is similar to that illustrated in FIG. 4, however, without the parasitic element that provides multi-band operation. Similar to that shown in FIG. 4, radiating element 208 is formed in a relatively tight loop in this embodiment to maximize volume utilization. It can be described as having two inverted L sections positioned adjacent to, and electrically connected to a partially closed loop section. This loop arrangement can be utilized to provide confinement of the fields helping to reduce the antenna's sensitivity to its surroundings, providing more consistent and reliable operation. Alternatively, another way to increase the immunity to interference from surroundings would be to use a higher dielectric material, however the increased permittivity of the higher dielectric material would result in greater losses, which is an undesirable effect.

Radiating element 208 includes a first section 416 and a second section 414. Also illustrated in FIG. 8 are a ground post 408 and feed pin 404. In this and other embodiments, a slot could be added in radiating element 208 to provide operation at yet another frequency band. In one embodiment, such a slot could be either L shaped or U shaped. As would be apparent to one of ordinary skill in the art after reading this description, alternative modifications can be made to the antenna to allow operation at multiple frequency bands.

The physical length of this element 418 roughly corresponds to a quarter wavelength, or $\lambda/4$, as compensated for by local dielectric effects and the parasitic shunt capacitance of parasitic element 442, although other lengths are possible. For low-band operation in the example application of 800 MHz, $\lambda/4$ is approximately 89 mm.

The various conductive elements of the PIFA as described herein, can be manufactured using any number of conductive materials, including copper, copper barium, phosphor bronze and the like. After reading this description, it will become obvious to one of ordinary skill in the art how to implement the antenna using appropriate conductive materials given various considerations such as availability, cost, performance, efficiency, safety and ease of manufacture.

While particular example and alternative embodiments of the present intention have been disclosed, it will be apparent to one of ordinary skill in the art that many various modifications and extensions of the above described technology may be implemented using the teaching of this invention described herein. All such modifications and extensions are intended to be included within the true spirit and scope of the invention as discussed in the appended claims.

What is claimed is:

1. A planar inverted F antenna comprising:

a ground plane disposed in a first plane; and a radiating element comprising:

a tuning section disposed in a second plane parallel to the first plane and connected to the ground plane; and a capacitive loading section connected to the tuning section and disposed in a third plane parallel to the first plane and between the first plane and the second plane, the capacitive loading section not positioned between the tuning section and the ground plane along any line perpendicular to the ground plane and extending from the ground plane to the tuning section.

2. The antenna of claim 1, further comprising at least one parasitic element connected to the radiating element.

3. The antenna of claim 1, wherein the tuning element comprises at least one of a variable length radiating section and a circuit element.

4. The antenna of claim 1, further comprising a ground post connecting the radiating element to the ground plane.

5. The antenna of claim 4, wherein the ground post is at least one of a pin, post or wall.

6. The antenna of claim 1, wherein the radiating element is configured in a loop.

7. A wireless communication device, comprising:

a printed circuit board including one or more operational components of the wireless communication device, the printed circuit board including a radio transmitter, receiver, and a ground plane; and an antenna comprising:

a ground plane disposed in a first plane; and a radiating element comprising:

a tuning section disposed in a second plane parallel to the first plane and connected to the ground plane through a ground post; and a capacitive loading section connected to the tuning section and disposed in a third plane parallel to the first plane and between the first plane and the second plane, the capacitive loading section not positioned between the tuning section and the ground plane along any line perpendicular to the ground plane and extending from the ground plane to the tuning section;

the ground post, electrically connecting the radiating element to the ground plane; and a feed electrically connecting the radiating element to the at least one of a radio transmitter and receiver.

8. The wireless communication device of claim 7, wherein the capacitive loading section comprises:

a first conductive section connected to the tuning element and extending from the tuning element toward the ground plane; and a second conductive section disposed in the second plane and electrically connected to the first conductive section.

9. The wireless communication device of claim 7, wherein the radiating element comprises two inverted L-shaped sections disposed adjacent to a partially opened loop section, such that one end of each of the inverted L-shaped sections is electrically connected to a respective end of the partially opened loop section.

10. The wireless communication device of claim 7, further comprising a parasitic element.

11. The wireless communication device of claim 7, wherein the tuning element comprises at least one of a variable length radiating section and a circuit element.

12. The wireless communication device of claim 7, wherein the ground post is at least one of a pin, post or wall.

13. The wireless communication device of claim 7, wherein the radiating element is configured in a loop.

* * * * *